US008635785B2

(12) United States Patent
Seo

(10) Patent No.: US 8,635,785 B2
(45) Date of Patent: Jan. 28, 2014

(54) MIDSOLE FOR A SHOE

(75) Inventor: Woo Seung Seo, Seoul (KR)

(73) Assignee: Jione FRS Corporation, Geumcheon-Gu, Seoul (KR)

( * ) Notice: Subject to any disclaimer, the term of this patent is extended or adjusted under 35 U.S.C. 154(b) by 240 days.

(21) Appl. No.: 13/154,835

(22) Filed: Jun. 7, 2011

(65) Prior Publication Data

US 2012/0079747 A1 Apr. 5, 2012

(30) Foreign Application Priority Data

Oct. 5, 2010 (KR) ..... 10-2010-0096718

(51) Int. Cl.
*A43B 13/00* (2006.01)

(52) U.S. Cl.
USPC ..... 36/25 R; 36/27

(58) Field of Classification Search
USPC ..... 36/27, 37, 107, 25 R, 103, 28
See application file for complete search history.

(56) References Cited

U.S. PATENT DOCUMENTS

| | | | | |
|---|---|---|---|---|
| 5,337,492 | A * | 8/1994 | Anderie et al. | 36/28 |
| 5,678,327 | A * | 10/1997 | Halberstadt | 36/27 |
| 6,886,274 | B2 * | 5/2005 | Krafsur et al. | 36/27 |
| 7,100,308 | B2 * | 9/2006 | Aveni | 36/27 |
| 7,418,790 | B2 * | 9/2008 | Kerrigan | 36/27 |
| 7,421,805 | B2 * | 9/2008 | Geer | 36/25 R |
| 7,574,817 | B2 * | 8/2009 | Fechter | 36/27 |
| 8,365,442 | B2 * | 2/2013 | Baker et al. | 36/59 R |
| 8,387,279 | B2 * | 3/2013 | Pauk et al. | 36/25 R |

* cited by examiner

*Primary Examiner* — Jila M Mohandesi
(74) *Attorney, Agent, or Firm* — Roetzel & Andress; Michael J. Keller

(57) ABSTRACT

A midsole for a shoe comprising an upper midsole and a lower midsole, and further comprising a reinforcing member being embedded in between the upper midsole and the lower midsole. The reinforcing member includes a foot-shaped reinforcing plate and a plurality of wings being repeatedly rounded alternately upwards and downwards, and a plurality of grooves being formed on both sides of a bottom surface of the upper midsole, and a plurality of ribs forming both sides of the lower midsole, in which the ribs correspond to the wings of the reinforcing member and the wings are exposed to the outside of the midsole. The midsole disperses shock and allows for an easy walking motion.

5 Claims, 6 Drawing Sheets

MIDSOLE FOR A SHOE

This invention claims the benefit of Korean Patent Application No. 2010-0096718 filed on Oct. 5, 2010, which is hereby incorporated by reference in its entirety.

BACKGROUND OF THE INVENTION

1. Field of the Invention

The present invention relates generally to a midsole for a shoe, more particularly to a midsole for a shoe which is capable of safely performing the shock-dispersing function and the same foot rolling function, which is capable of making the wearer feel soft on he or her feet with a nice cushiony landing feel to them while walking or stop, which is capable of peacefully supporting the sole of the foot on which most of the wearer's weight may be applied, which is capable of distributing the wearer's weight on the feet and of minimizing foot fatigue of the wearer while standing, walking or running in such a manner as to promote the wearer's comfort and health, by embedding a reinforcing member in between an upper midsole and a lower midsole so as to enhance the strength of the midsole, and which is capable of providing an attractive appearance for the shoe by making a part of the reinforcing member of the midsole to be exposed to the outside.

2. Description of the Prior Art

Many different types of shoes for protecting feet of a person have been available in the market. Generally, the sole part of the shoe may be designed to protect the wearer's body by relieving the shock to be applied on the shoe sole from the heel portion to the toe portion in accordance with the walking course of the wearer.

Typically, the most common type of the shoes was consisted of a sheath for covering and protecting the top of the foot and the ankle portion of the wearer, and a sole of the shoe for providing good bottom support, elastic air cushioning and shock-absorbing effects for relieving foot pressure. The sole mainly comprises a low sole, a midsole and an inner sole.

The low sole serves as a ground contact part and this may be made to have certain strength and to withstand friction in walking or running. The midsole may be attached onto an upper surface of the low sole so as to provide the wearer with the elastic air cushioning effect. The inner sole serves as a sole contact part and this is mounted onto an upper surface of the midsole.

In the typical shoes as described above, in order to obtain shock-absorbing effects for relieving foot pressure, the insoles of a pair of shoes may be located on an inner bottom surface of the shoe, which the soles of your feet rest on. Alternative the sole of the shoe and the heel portion of the shoes may be made of a soft layer such as a rubber or a foaming sponge having excellent shock-absorbing effects. Alternatively, any elastic member such as an air bag or a spring can be installed in the sole.

In a case that the sole of the shoe and the heel portion the shoes are made of a rubber or a foaming sponge, or any elastic member such as an air bag or a spring is installed in the sole as described above, only shock-absorbing effects for relieving foot pressure can be obtained. Considering that the heel portion, the arch-shaped middle portion and the toe portion of the sole may be touched with the ground in sequence in accordance with a predetermined walking course of the wearer while walking or running, then conventional shoe soles to be employed in many different types of shoes cannot provide the wearer with natural and efficient walking effects.

Recently, due to improvement in the standard of living and the diffusion of the policy of five-day work week, the population of enjoying outdoor activities will highly expand to come. Considering the trend of outdoor activities, the shoe manufactures have developed many different types of functional shoes, which are capable of providing a person enjoying outdoor activities with good feelings to wear and which provides resilient, cushioned support for the sole of the foot, the foot joint and the knee joint of the wearer, and which distributes the wearer's weight on the feet while standing, walking or running in such a manner as to promote his or her comfort and health.

Anti-slipping function, shock-absorbing function, bad smell removing function and athlete's foot preventing function due to operation of the ventilation among the variety of functions which can be applied to the shoes have been already actively practiced. In addition, the shoe manufactures have developed many different types of functional shoes, which are capable of providing the wearer with shock-absorbing effects in walking and which are capable of allowing the wearer to efficiently walk in a very natural way in such a manner that a ball rolls over a plane, which is so called by the same foot rolling function.

In view of this, the present applicant has developed a plurality of inventions related to functional shoes and a device for aid of walking adapted to be employed thereto, which are capable of allowing the wearer to perform the same foot rolling function in a very natural way during the entire walking gait cycle of the wearer. See for example, Korean Patent No. 10-0884659, which was filed on Sep. 8, 2008 in Korean Patent Application No. 10-2008-0088150, which discloses a midsole for a shoe with impact dispersion effects and the same foot rolling function.

In this Korean Patent No. 10-0884659, the midsole developed by the present applicant comprises a plurality of depressions on the unevenly patterned surface of a bottom surface of the midsole, in which the depressions are spaced from each other with a predetermined gap along the longitudinal direction thereof; a shock-absorbing space provided on the upper surface of the midsole; and a plurality of protruding ribs formed in the shock-absorbing space in such a way as to make a middle area corresponding to the depressions. Due to this structure, the midsole can be substantially transformed at an arc shape over the total surface of the sole in accordance with the walking course of the wearer. Accordingly, it can be adapted to perform the same foot rolling function. In addition, it is possible to allow the wearer to efficiently walk in a very natural way so that the knee joint and the ankle of the wearer can be protected.

However, a drawback of such known midsole for aid of walking is that an excessive compressed transform may be occurred by the depressions, thereby resulting in excessive increase of the flexibility and dissatisfaction of performing the walking function with safe.

SUMMARY OF THE INVENTION

In consideration of the above-mentioned disadvantages or inconveniences of the conventional midsole, the present invention provides a midsole for a shoe of the type in which it constitutes a part of a shoe sole and includes an upper midsole and a lower midsole, the improvements including: being a reinforcing member being embedded in between the upper midsole and the lower midsole, the reinforcing member including a plurality of wings which are likely to be exposed to the outside; a plurality of ribs being formed both sides of the lower midsole, in which the ribs correspond to the wings of the reinforcing member; and a plurality of grooves being formed both sides of a bottom surface of the upper midsole, in which the grooves correspond to the wings of the reinforcing member.

The first technical aspect of the present invention is to provide a midsole for a shoe which is capable of safely performing the same foot rolling function by embedding a reinforcing member in between an upper midsole and a lower midsole so as to enhance the strength of the midsole and to minimize the dangers of excessive flexibility in the sole of the shoe during the entire walking gait cycle of the wearer.

The second technical aspect of the present invention is to provide a midsole for a shoe which is capable of making the wearer feel soft on he or her feet with a nice cushiony landing feel to them while walking or stop, which is capable of peacefully supporting the sole of the foot on which most of the wearer's weight may be applied, which is capable of distributing the wearer's weight on the feet and of minimizing foot fatigue of the wearer while standing, walking or running in such a manner as to promote the wearer's comfort and health.

The third technical aspect of the present invention is to provide a midsole for a shoe which is capable of providing an attractive appearance for the shoe by making wings of the reinforcing member of the midsole to be exposed to the outside, by changing the length of the exposed wings, and by creating some characters or figures with the aid of the exposed wings.

In order to achieve the above technical aspects, the present invention provides a midsole for a shoe of the type in which it constitutes a part of a shoe sole and includes an upper midsole and a lower midsole, the improvements including: a reinforcing member being embedded in between the upper midsole and the lower midsole; the reinforcing member including a foot-shaped reinforcing plate and a plurality of wings protruding from both sides of the reinforcing plate at a predetermined length, in which the wings are formed along an outer circumferential surface of the reinforcing plate at regular intervals, and outer ends of the wings are repeatedly rounded alternately upwards and downwards; a plurality of grooves being formed both sides of a bottom surface of the upper midsole, in which the grooves correspond to the wings of the reinforcing member; a plurality of ribs being formed both sides of the lower midsole, in which the ribs correspond to the wings of the reinforcing member; and the wings being exposed to the outside of the midsole.

The wings extend toward a sheath of the shoe so as to keep shoe wearer's balance while the wearer is standing still and also during each step while walking or running.

The wings may establish tie with neighboring wings and create a character or a figure so as to provide an attractive appearance for the midsole.

The reinforcing member comprises a plurality of spaces extending along the width direction of the reinforcing plate.

As described above, according to embodiments of the present invention, it is possible to safely perform the same foot rolling function by embedding a reinforcing member in between an upper midsole and a lower midsole so as to enhance the strength of the midsole and to minimize the dangers of excessive flexibility in the sole of the shoe during the entire walking gait cycle of the wearer. In addition, it is possible to make the wearer feel soft on he or her feet with a nice cushiony landing feel to them while walking or stop. In addition, it is possible to peacefully support the sole of the foot on which most of the wearer's weight may be applied. Furthermore, it is possible to distribute the wearer's weight on the feet and of minimizing foot fatigue of the wearer while standing, walking or running in such a manner as to promote the wearer's comfort and health. Finally, it is possible to provide an attractive appearance for the shoe by making wings of the reinforcing member of the midsole to be exposed to the outside, by changing the length of the exposed wings, and by creating some characters or figures with the aid of the exposed wings.

BRIEF DESCRIPTION OF THE DRAWINGS

The above object and other characteristics and advantages of the present invention will become more apparent by describing in detail preferred embodiments thereof with reference to the attached drawings, in which.

DETAILED DESCRIPTION OF THE INVENTION

Figure 1:
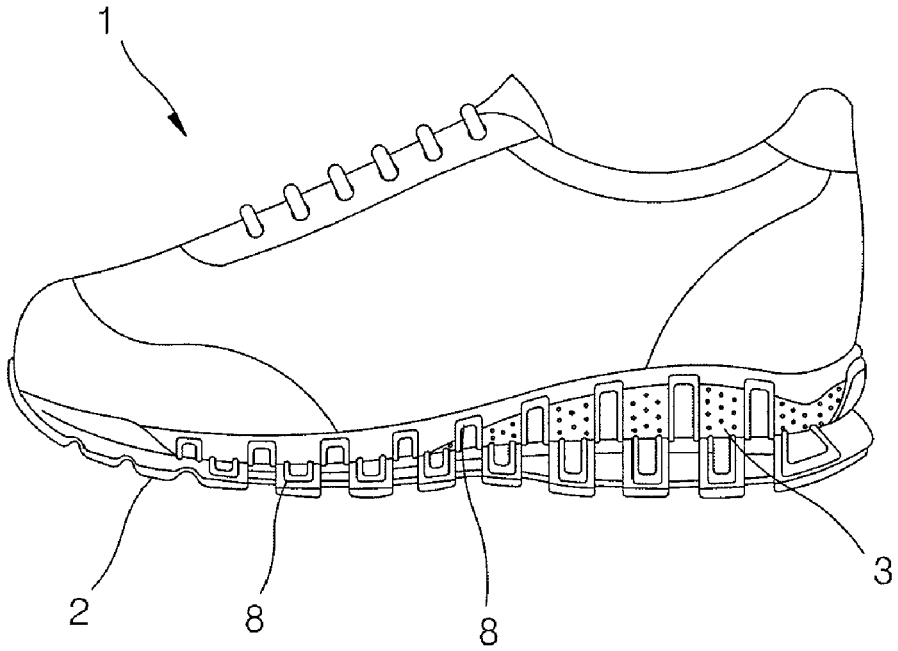
FIG. 1 is a side view of a shoe of which a midsole according to a preferred embodiment of the present invention is employed therein.

Hereinafter, the constitution and the operation of midsoles according to the preferred embodiments of the present invention will be explained in more detail with reference to the accompanying drawings FIGS. 1 to 9B.

Prior to proceeding to the more detailed description of the preferred embodiments according to the present invention, it should be noted that, for the sake of clarity and understanding of the invention identical components which have identical functions have been identified with identical reference numerals throughout the different views which are illustrated in each of the attached drawing Figures.

Figure 2:
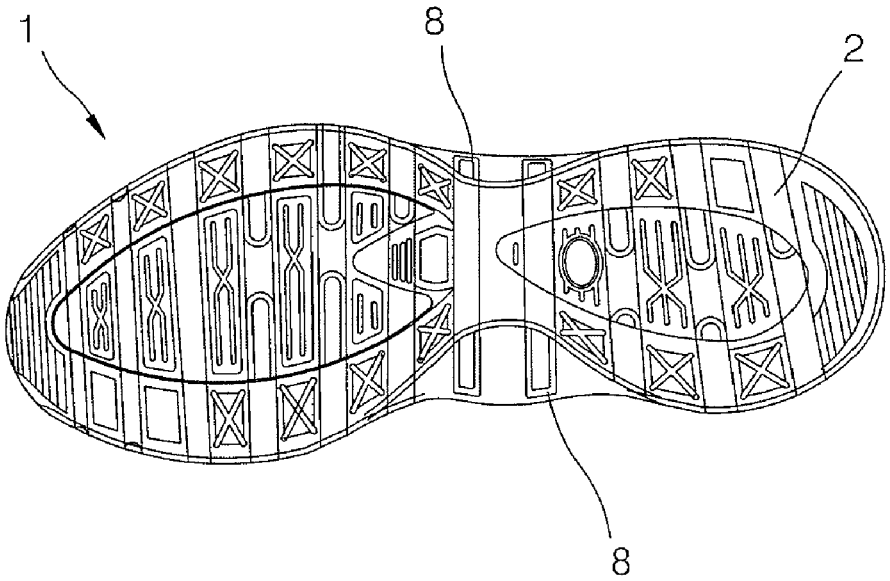
FIG. 2 is a bottom view of the shoe of which a midsole according to the preferred embodiment of the present invention is employed therein.
Figure 3:
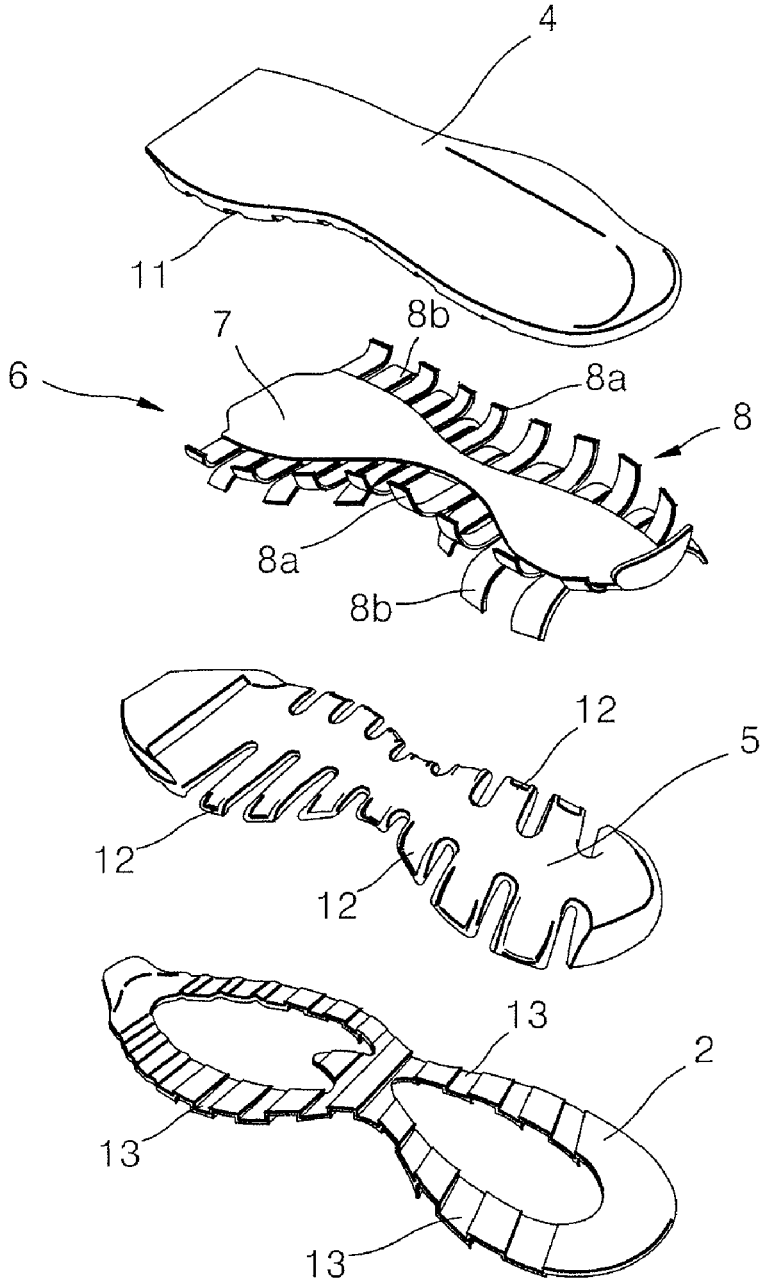
FIG. 3 is an exploded perspective view of the midsole according to the preferred embodiment of the present invention and a sole.

Referring to FIGS. 1 to 3, a midsole 3 for shoes according to the present invention is a one element of a shoe sole of a shoe 1 and it is attached onto a low sole 2. The midsole 3 comprises an upper midsole 4 and a lower midsole 5, which are engaged with each other. A reinforcing member 6 is embedded in between the upper midsole 4 and the lower midsole 5.

Preferably, the reinforcing member 6 is made of a synthetic resin. The reinforcing member 6 includes a foot-shaped reinforcing plate 7 and a plurality of wings 8 protruding from both sides of the reinforcing plate 7 at a predetermined length.

Figure 4:
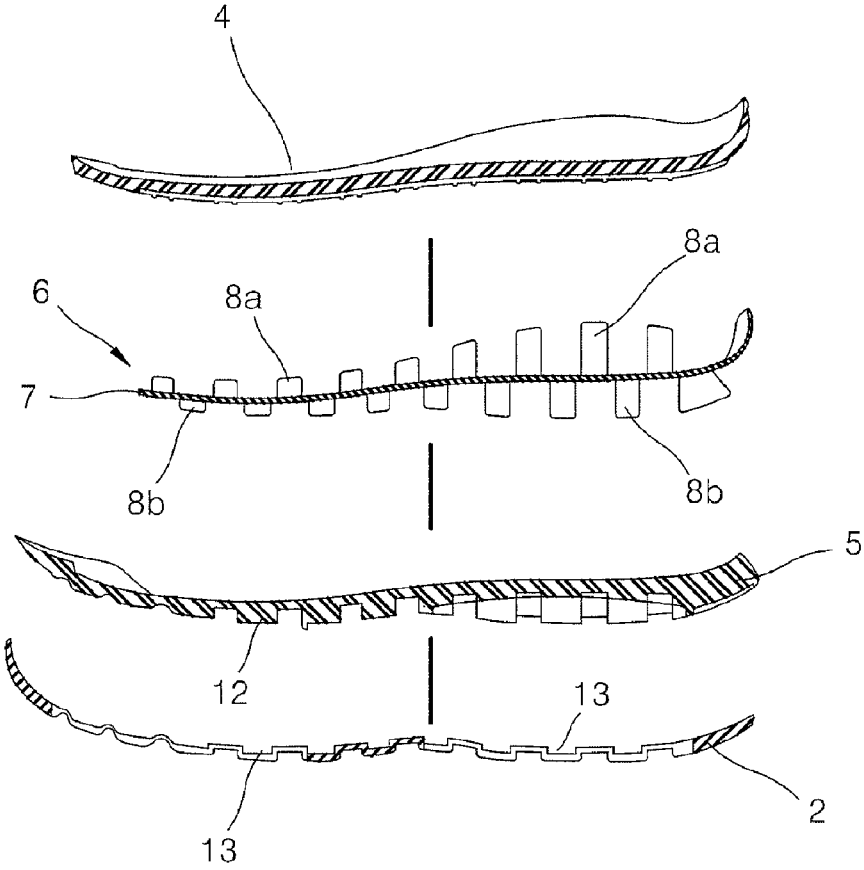
FIG. 4 is a side view of the midsole and the sole as shown in FIG. 3.
Figure 5:
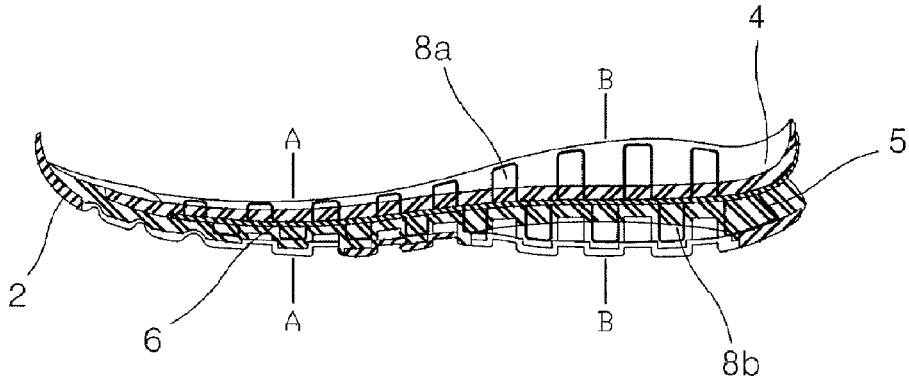
FIG. 5 is a side sectional view of the midsole and the sole, for showing the state that they are combined together.

Referring to FIGS. 4 and 5, the wings 8 are formed along an outer circumferential surface of the reinforcing plate 7 at regular intervals, and outer ends of the wings 8 are repeatedly rounded alternately upwards and downwards.

When the reinforcing member 6 is embedded in between the upper midsole 4 and the lower midsole 5 of the midsole 3, the ends of the wings 8 may be exposed to the outside of the midsole 3 through both side surfaces of the midsole 3. Since the ends of the wings 8 are rounded upwards or downwards at the outside of the midsole 3, they may have relatively strong elastic force.

It will be understood by those skilled in the art that various changes may be made for the shape of wings 8 without departing from the scope of the invention. Although the outer ends of the wings 8 are shown that they are repeatedly rounded alternately upwards and downwards in the attached drawings, each of wings 8 can be irregularly rounded upwards and downwards. In addition, one or more ribs can be formed at each of the wings 8 and the reinforcing plate 7 so as to enhance the strong property of them. At this time, the rib or ribs may be formed at the center portion or the outer periphery surface of each of the wings 8 and the reinforcing plate 7.

As best seen FIG. 3, the reinforcing member 6 substantially corresponds to the outer periphery shape of the midsole 3, and it has a further enlarged wing at its heel portion.

Referring to FIGS. 1 to 4, when the reinforcing member 6 is embedded in between the upper midsole 4 and the lower midsole 5 of the midsole 3, the reinforcing plate 7 may be completely embedded in the midsole 3. At this time, the outer ends of the wings 8 may be exposed to the outside of the midsole 3.

Figure 6:
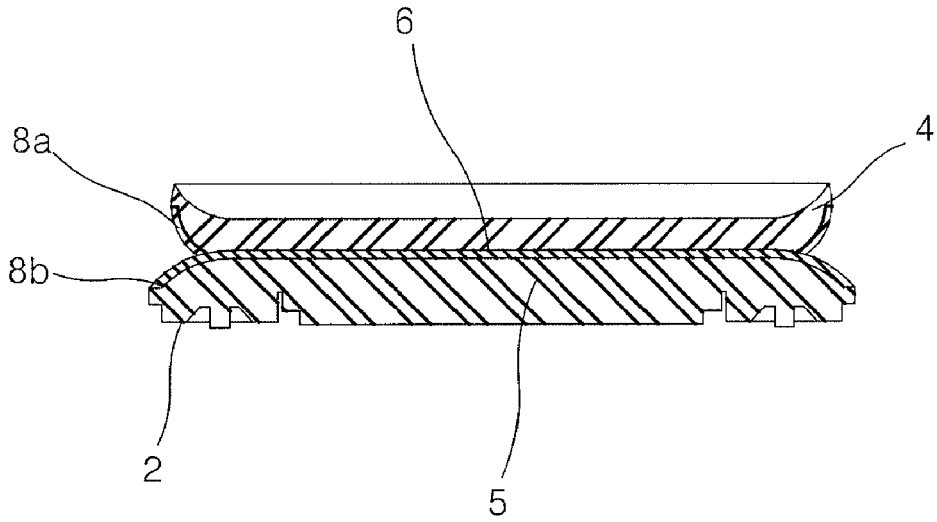
FIG. 6 is a sectional view taken along line "A-A" as illustrated in FIG. 5.
Figure 7:
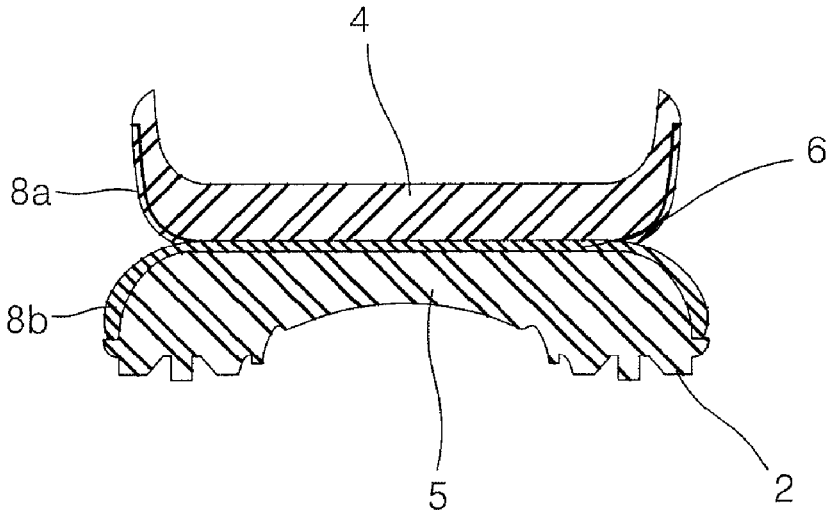
FIG. 7 is a sectional view taken along line "B-B" as illustrated in FIG. 5.

FIGS. 5 to 7 show the state that the outer ends of the wings 8 are rounded upwards or downwards. Referring to FIGS. 5 to 7, wings 8*a* rounded upwards may be pressed against lower portions of both side surfaces of the upper midsole 4. Alternatively, wings 8*b* rounded downwards may be pressed against upper portions of both side surfaces of the lower midsole 5.

In other words, the outer ends of the wings 8 may be pressed against side surfaces of the upper midsole 4 or the lower midsole 5 in the manner that they partially wrap around the side surfaces thereof. When we look at the outer ends of the wings 8 on the sides, it will be known that the wings 8*a* and the wings 8*b* alternatively and repeatedly protrude upwards and downwards, respectively.

Now referring again FIG. 3, a plurality of grooves 11 are formed at both sides of a bottom surface of the upper midsole 4 so as to stably hold the outer ends of the wings 8. The grooves 11 are adapted to receive and to support the outer ends 8*a* of the wings 8, which are rounded upwards. The outer ends 8*a* of the wings 8 are snugly received in the grooves 11 and then they are fixed therein with the glue.

Although shoes are irregularly shaken during the entire walking gait cycle of the wearer, the wings 8*a* may do not offset their positions and maintain a stable state due to the existence of the grooves 11. At this time, the wings 8*a* only elastically move together with the midsole 3 at the same place.

It will be understood by those skilled in the art that a plurality of grooves such as the grooves 11 can be formed at both sides of an upper surface of the lower midsole 5 so as to stably hold the outer ends of the wings 8. However, the attached drawings show another type of embodiment in conjunction with a stable fixation of the wings 8*b*. In detail, a plurality of ribs 12 are formed at both sides of the lower midsole 5.

The ribs 12 have free ends which correspond to the wings 8*b* of the reinforcing member 6. Each of free ends of the ribs 12 is attached to each of wings 8*b*, which are rounded downwards, with the glue. As a result, the wings 8*b* can have more freely elastic response.

Since the wings 8*b* rounded downwards have more freely elastic response in comparison with the wings 8*a* rounded upwards, the winds 8*a* make it possible to stably cover the foot of the wearer. Furthermore, the lower midsole 5 can be compressed and transformed due to the operation of the ribs 12 during the entire walking gait cycle of the wearer so that it can perform the same foot rolling function. In addition, it is possible to obtain the stability in walking due to the operation of the wings 8*b* rounded downwards.

Meanwhile, the lower sole 2 attached to the bottom surface of the midsole 3 may assume the form of unevenly patterned surface as shown in FIG. 4.

In detail, a plurality of depressions 13 on the unevenly patterned surface correspond to the wings 8*b* of the reinforcing member 6. The ribs 12 integrally engaged with the wings 8*b* are fixed into the depressions 12 and attached thereto with the glue. Due to the structure, the wings 8*b* can more directly contact with the ground.

It should be appreciated by one of ordinary skill, that the constitution of the shoe sole may vary based on the application or the distinct characteristics of the shoes and the type of the midsole.

Herein below, the operation of the midsole 3 according to the preferred embodiment of the present invention will be explained.

The midsole 3 according to the present invention may be manufactured by performing the steps of embedding the reinforcing member 6 into between the upper midsole 4 and the lower midsole 5 and then fixing it thereto with the glue; attaching the low sole 2 to the bottom surface of the lower midsole 5; and attaching the sheath (as shown in FIG. 1) of the shoes onto the upper surface of the upper midsole 4.

If a wearer walks with wearing the shoes 1 of which the midsole 3 according to the present invention is employed thereto, he or she can feel good to wear and feel comfortable in walking or running in such a manner as to promote his or her comfort and health. Since the winds 8*a* received in the grooves 11 of the upper sole 4 and rounded upwards may stably cover the sheath of the shoes 1, it make it possible to stably support the foot of the wearer.

When the wearer walks with wearing the shoes 1 of which the midsole 3 according to the present invention is employed thereto, the lower midsole 5 and the upper sole 4 may be compressed and transformed so that the wearer can perform the same foot rolling function. At this time, if the reinforcing member 6 embedded in between the upper sole 4 and the lower sole 5 has a proper strength required for preventing the excessive transformation of them, it make it possible to perform the same foot rolling function with safe.

Meanwhile, when the wearer walks or stops walking with wearing the shoes 1 of which the midsole 3 according to the present invention is employed thereto, the wings 8*b* rounded downwards and the ribs 12 formed at the lower midsole 5 can absorb shock so that the wearer can feel soft on he or her feet with a nice cushiony landing feel to them. Further, it is possible to distribute the wearer's weight on the feet while standing, walking or running in such a manner as to promote his or her comfort and health.

Figure 8A:
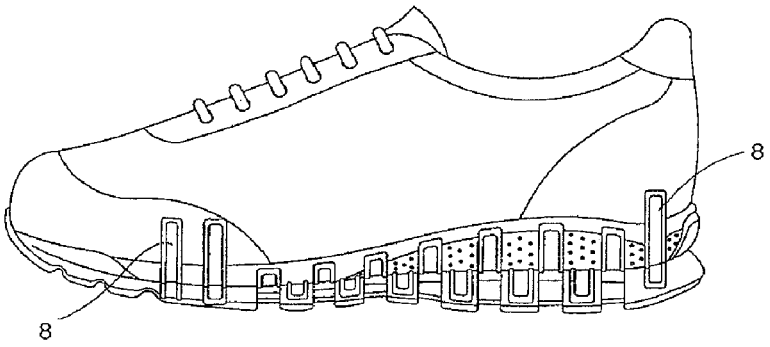
FIGS. 8A to 8C show a shoe of which a midsole according to other preferred embodiment of the present invention is employed therein.
Figure 8B:
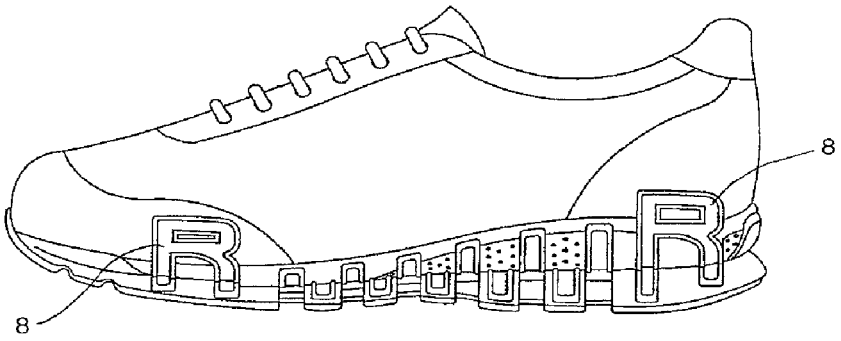
Figure 8C:
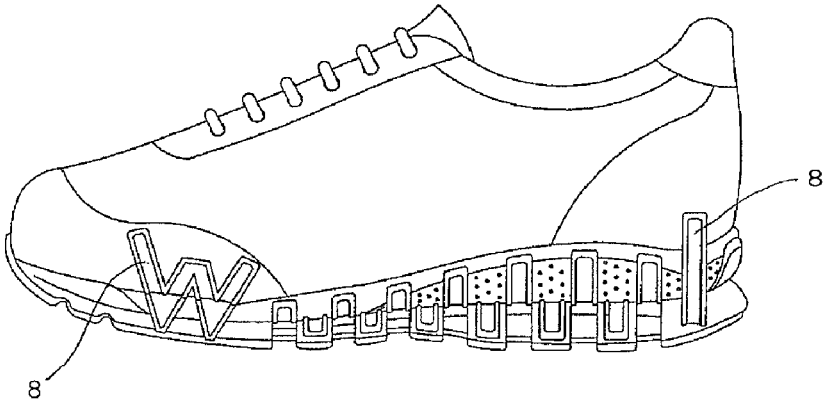

FIGS. 8A to 8C show shoes of which a midsole according to another embodiment of the present invention is employed thereto.

Referring to FIG. 8A, the wings 8 of the reinforcing member 6 are rounded upwards at both sides of the shoe 1 and they long extend toward the sheath of the shoe 1 so as to further effectively maintain the balance of the wearer's foot while the wearer is standing still and also during each step while walking or running. Referring to FIG. 8B, the wings 8 may establish tie with neighboring wings 8 and create a character or a figure so as to provide an attractive appearance for the midsole. Those skilled in the art may appreciate that the conception as illustrated in FIGS. 8A and 8B can all be realized together. Therefore, referring to FIG. 8C, the wings 8 of the reinforcing member 6 can be long extended toward the sheath of the shoe 1 as illustrated in FIG. 8A and the wings 8 can create a character or a figure as illustrated in FIG. 8B by establishing tie with neighboring wings 8.

Figure 9A:
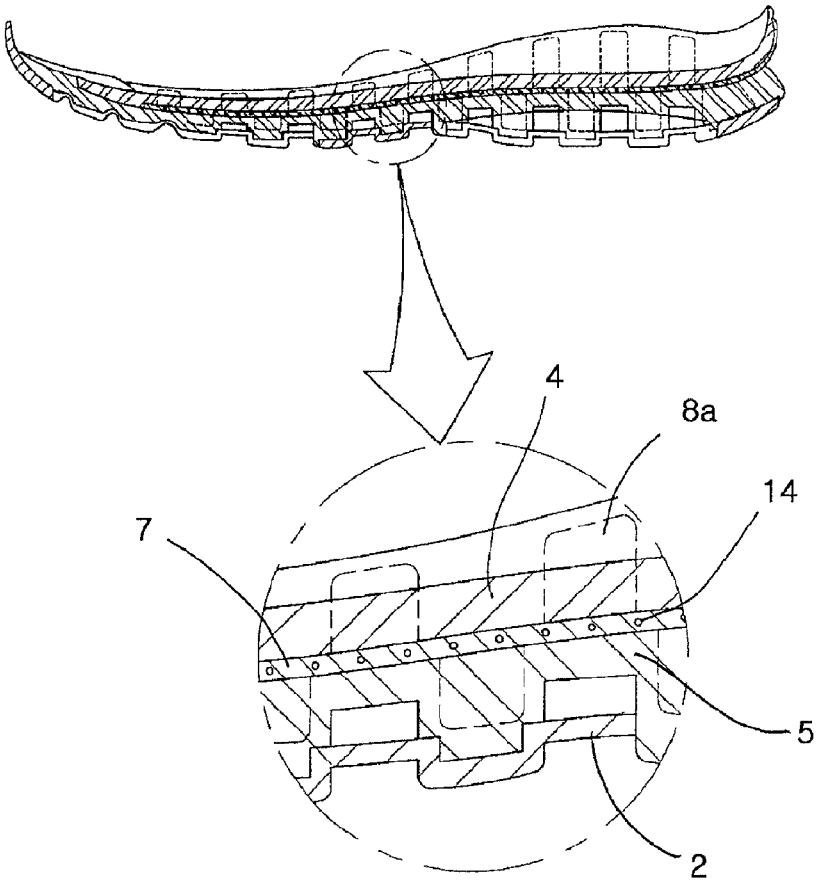
FIGS. 9A and 9B are sectional views of the midsole of which a reinforcing member according to other preferred embodiment of the present invention is employed thereto.
Figure 9B:
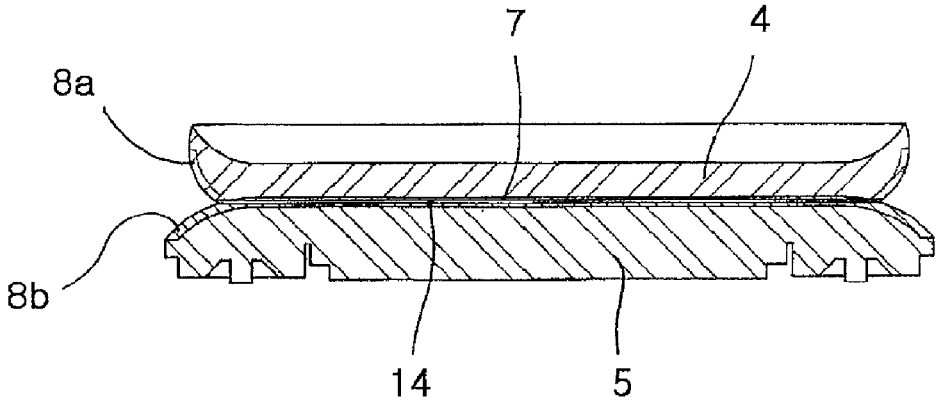

FIGS. 9A and 9B are sectional views of the midsole of which a reinforcing member according to other preferred embodiment of the present invention is employed thereto. Referring to FIGS. 9A and 9B, the reinforcing member 6 comprises a plurality of spaces 14 extending along the width direction of the reinforcing plate 7. These spaces 7 can peacefully support the sole of the foot on which most of the wearer's weight may be applied so that they can provide elastic air cushioning and shock-absorbing effects for relieving foot pressure in walking or running.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A midsole for a shoe of the type in which it constitutes a part of a shoe sole and includes an upper midsole and a lower midsole, the improvement comprising:

a reinforcing member being embedded in between the upper midsole and the lower midsole;

the reinforcing member including a foot-shaped reinforcing plate and a plurality of wings protruding from both sides of the reinforcing plate at a predetermined length, in which the wings are formed along an outer circumferential surface of the reinforcing plate at regular intervals, and outer ends of the wings are repeatedly rounded alternately upwards and downwards;

a plurality of grooves being formed both sides of a bottom surface of the upper midsole, in which the grooves correspond to the upwardly rounded wings of the reinforcing member;

a plurality of ribs being formed both sides of the lower midsole, in which the ribs extend from a central portion of the lower midsole to have free ends respectively and correspond to the downwardly rounded wings of the reinforcing member; and the wings being exposed to the outside of the midsole, wherein each of free ends of the ribs is attached to each of the downwardly rounded wings, thereby the downwardly rounded wings provide elastic responses freely and independently.

2. The midsole for a shoe as claimed in claim 1, wherein the wings extend toward a sheath of the shoe so as to keep shoe wearer's balance while the wearer is standing still and also during each step while walking or running.

3. The midsole for a shoe as claimed in claim 2, wherein the reinforcing member comprises a plurality of spaces extending along the width direction of the reinforcing plate.

4. The midsole for a shoe as claimed in claim 1, wherein the wings may establish tie with neighboring wings and create one of a character and a figure so as to provide an attractive appearance for the midsole.

5. The midsole for a shoe as claimed in claim 4, wherein the reinforcing member comprises a plurality of spaces extending along the width direction of the reinforcing plate.

* * * * *